US008572798B2

(12) United States Patent
Lychwick

(10) Patent No.: US 8,572,798 B2
(45) Date of Patent: Nov. 5, 2013

(54) SCRATCH-OFF CARD SURFACE REMOVER

(76) Inventor: Kurt Lychwick, Greenfield, WI (US)

( * ) Notice: Subject to any disclaimer, the term of this patent is extended or adjusted under 35 U.S.C. 154(b) by 316 days.

(21) Appl. No.: 12/653,900

(22) Filed: Dec. 21, 2009

(65) Prior Publication Data

US 2011/0146019 A1 Jun. 23, 2011

(51) Int. Cl.
*A47L 17/06* (2006.01)

(52) U.S. Cl.
USPC ..... 15/236.01; 15/236.07

(58) Field of Classification Search
USPC ..... 15/236.01, 236.07; D32/46, 48, 49
See application file for complete search history.

(56) References Cited

U.S. PATENT DOCUMENTS 1,598,811 A * 9/1926 Ferrin ..... 401/263
4,654,923 A * 4/1987 Faciane et al. ..... 15/236.01
4,757,567 A * 7/1988 Booker ..... 15/105
5,114,146 A * 5/1992 Booker ..... 273/144 A
6,012,227 A * 1/2000 Lent ..... 30/169
6,061,862 A * 5/2000 Whitaker ..... 15/111
6,061,913 A * 5/2000 Grieshaber et al. ..... 30/169
6,625,840 B1 * 9/2003 Hansen et al. ..... 15/245
2008/0092314 A1 * 4/2008 Griffin ..... 15/111

* cited by examiner

*Primary Examiner* — Randall Chin

(57) ABSTRACT

A scratch-off card surface remover comprised of a single body assembly. The single body assembly contains a forward extruded scraping tip wherein the tip is a half sphere shape that contains a flat plane scraping edge and of which this shape is directly centered on and extending from the forward area of an elliptical mount formed directly to a middle obtruded hollow barrel hand grip further directly formed to an aft hollow barrel section containing two oppositely correlated perforations for the insertion of a means by which to carry and store the assembly. The horizontal movement of the single body assembly as applied to the surface of a scratch-off card empowers the scraping characteristic of the scraping tip portion of the assembly.

3 Claims, 1 Drawing Sheet

SCRATCH-OFF CARD SURFACE REMOVER

BACKGROUND OF THE INVENTION

1. Field of the Invention

This invention is in the field of scratch-off cards. In particular, the present invention relates to a scratch-off card surface remover used to remove the waxy latex surfaces from lottery game cards.

2. Description of the Related Art

In removing the playing surface on a lottery card, a finger nail, coin or the like is typically used for removal. Unfortunately, when users remove the cards surface with a finger nail, coin or the like, there is a tendency to remove beyond the boundaries of a particular space so that the spaces are often misread because the user mistakenly removes the surface outside of the boundary. Another issue is the amount of time required to completely and accurately remove the surface of lottery card spaces. Yet another issue is that when a finger nail, coin or the like is used for removal, the revealed game playing spaces may be scraped beyond recognition. An additional issue is that of conveniently carrying and storing a removal device.

Finally, a further issue is that of effectively and totally removing the surface of the playing spaces of the lottery card as the waxy latex covering of the game cards themselves can vary between the various games and different card manufacturers. Accordingly, there is a need for a scratch-off card surface remover with the surface removal capability to consistently and effectively adapt to any of these surface covering variations.

Accordingly, there is a need for a scratch-off card surface remover with a naturally comfortable, unforced and effortless means by which to grip it while performing the removal task. There is also a need for a scratch-off card surface remover that can be economically manufactured.

SUMMARY OF THE INVENTION

One object of this invention is to provide a scratch-off card surface remover comprised of a single body assembly. The single body assembly contains a forward extruded scraping tip formed directly to a middle obtruded hollow barrel hand grip further directly formed to an aft hollow barrel section containing two oppositely correlated perforations for the insertion of a means by which to carry and store the assembly. The horizontal movement of the single body assembly as applied to the surface of a scratch-off card empowers the scraping characteristic of the scraping tip portion of the assembly.

Another object of this invention is to provide a scratch-off card surface remover comprised of a single body assembly. The single body assembly contains a forward extruded scraping tip formed directly to a middle obtruded hollow barrel hand grip further directly formed to an aft hollow barrel section containing two oppositely correlated perforations for the insertion of a means by which to carry and store the assembly and the horizontal movement of the single body assembly as applied to the surface of a scratch-off card empowers the scraping characteristic of the scraping tip portion of the assembly.

Yet another object of this invention is to provide a scratch-off card surface remover comprised of a single body assembly. The single body assembly contains a forward extruded scraping tip formed directly to a middle obtruded hollow barrel hand grip further directly formed to an aft hollow barrel section containing two oppositely correlated perforations for the insertion of a means by which to carry and store the assembly. The horizontal movement of the single body assembly as applied to the surface of a scratch-off card empowers the scraping characteristic of the assembly.

DETAILED DESCRIPTION OF THE PREFERRED EMBODIMENTS

Scratch-Off Card Surface Remover

Figure 1:
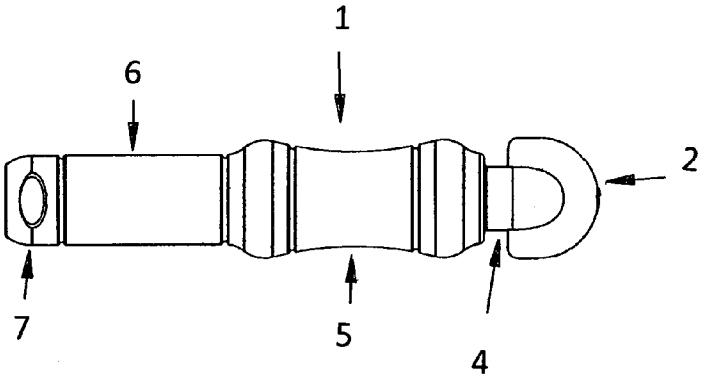
FIG. 1 is a perspective view of a single body assembly scratch-off card surface remover according to the preferred embodiment of the present invention.
Figure 2:
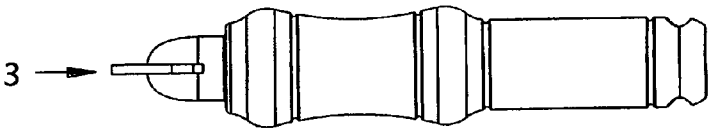
FIG. 2 is a side view of a single body assembly scratch-off card surface remover according to the preferred embodiment of the present invention.
Figure 3:
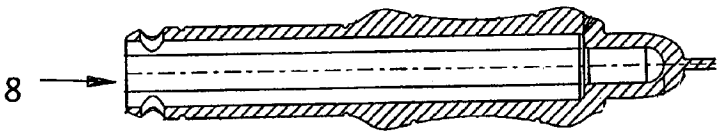
FIG. 3 is a cross sectional view of a single body assembly scratch-off card remover according to the preferred embodiment of the present invention.

FIGS. 1-2 illustrate a single body assembly scratch-off card surface remover 1 that includes a forward extruded scraping tip 2, a flat plane scraping edge 3, an elliptical mount 4, an obtruded hollow barrel hand grip 5, an aft hollow barrel section 6, two oppositely correlated perforations 7. FIG. 3 illustrates a single body assembly scratch-off card surface remover that is comprised of a hollow core 8. Remover 1 is approximately 3.725 inches in length.

Forward extruded scraping tip 2 includes a flat plane scraping edge 3. Forward extruded scraping tip 2 is a half sphere in shape that is approximately 0.755 inches in diameter and 0.255 in length from the upper most point in which it is directly attached to a an elliptical mount 4 which is approximately 0.400 in diameter and approximately 0.180 in length and is directly attached to the obtruded hollow barrel hand grip 5. Obtruded hollow barrel hand grip section 5 is approximately 1.625 inches in length and is further directly attached to the aft hollow barrel section 6 which is approximately 1.380 inches in length and contains two oppositely correlated perforations 7 which are an oval shape measuring approximately 0.300 in length by 0.150 in width.

In the preferred embodiment of the present invention, the single assembly lottery scratch card surface remover 1 is manufactured from a variety of grades of plastic. Lottery scratch card surface remover 1 may also be manufactured from metal or any other equivalent material known by one of ordinary skill in the art.

Lottery scratch-off card surface remover 1 removes the surface of a scratch-off lottery game card. Remover 1 is approximately 3.725 inches in length and 0.741 inches in diameter. This width allows for easy gripping and control. A user grasps obtruded hollow barrel hand grip 5 and applies forward extruded scraping tip 2 to the card in a horizontal motion to empower scraping of said extruded scraping tip 2 to remove a card surface.

The user holds remover 1 in a vertical position and places it over the surface to be removed. If horizontally moved once, remover 1 accurately removes a predefined surface area. If the user repeatedly horizontally moves remover 1, a larger surface area will be removed.

Many variations and modifications may be made to the invention without departing from the spirit thereof. The scope of other changes will become apparent from the attached claims. No limitation with respect to the specific device illustrated herein is intended or should be inferred.

What is claimed is:

1. A scratch-off card surface remover comprising:

a hollow single body assembly having a first end and a second end, wherein the first end provides an aperture that opens into the hollow single body assembly and at least one perforation formed near the aperture that opens into the hollow single body assembly, and the second end that is closed and extends to form a scraping tip; and, wherein the hollow single body assembly includes an obtruded hand grip portion formed on the outer surface of the hollow single body assembly directly adjacent to the scraping tip, wherein the scraping tip includes a half sphere section directly adjacent to the obtruded hand grip portion and a flat plane scraping edge section that extends from the half sphere section.

2. A scratch-off card surface remover according to claim 1, wherein the assembly is manufactured from plastic.

3. A scratch-off card surface remover according to claim 1, wherein the assembly is manufactured from metal.

* * * * *